United States Patent [19]

Sawa et al.

[11] 4,407,682

[45] Oct. 4, 1983

[54] METHOD OF PLASTIC WORKING OF METAL MATERIALS

[75] Inventors: Shigeki Sawa, Nagoya; Hiroyasu Nagasaka, Chiryu; Makoto Saito, Nagoya; Masashi Mizuno, Aichi; Katuhiro Kozima, Chita, all of Japan

[73] Assignee: Daido Tokushuko Kabushiki Kaisha, Japan

[21] Appl. No.: 363,345

[22] Filed: Mar. 29, 1981

[30] Foreign Application Priority Data

Apr. 6, 1981 [JP] Japan ..... 56-51498
May 14, 1981 [JP] Japan ..... 56-72681
Jul. 24, 1981 [JP] Japan ..... 56-116688

[51] Int. Cl.[3] ..... C21D 8/00
[52] U.S. Cl. ..... 148/128; 148/12 R
[58] Field of Search ..... 148/128, 12 R, 12 B, 148/129

[56] References Cited

U.S. PATENT DOCUMENTS 2,059,976 11/1936 Stargardter ..... 148/129
3,130,363 4/1964 Camp et al. ..... 148/129
3,247,364 4/1966 Waziri ..... 148/128

FOREIGN PATENT DOCUMENTS 53-44125 11/1978 Japan ..... 148/12 R
305907 2/1969 U.S.S.R. ..... 148/12 R
307110 3/1970 U.S.S.R. ..... 148/12 R
474564 5/1973 U.S.S.R. ..... 148/12 R

*Primary Examiner*—L. Dewayne Rutledge
*Assistant Examiner*—Debbie Yee
*Attorney, Agent, or Firm*—William A. Drucker

[57] ABSTRACT

Method of thermal plastic working of metal materials whereby a material is heated or cooled with measurements being made of variations in the metallographical condition of the material which may occur as the temperature of the material is varied due to the foregoing treatment. If the measurement shows that the material has effected a sudden change in its metallographical condition, the temperature having caused such a sudden change or higher temperature may be used to perform a desired plastic working of the material in its most plastic-workable condition.

9 Claims, 31 Drawing Figures

METHOD OF PLASTIC WORKING OF METAL MATERIALS

BACKGROUND OF THE INVENTION

1. Field of the Invention

This invention relates to methods of thermal plastic working of metal materials.

2. Description of the Prior Art

It is well known that, when a metal material undergoes metallographical changes during processing, the phenomenon called "superplasticity" may present itself to provide the possibility of an extremely large plastic working of the material, and the method of plastic working utilizing this nature has been introduced in an industrial scale.

The above mentioned introduction originated with the invention of an improved method of plastic working of metal material by the inventors herein, followed by the utilization thereof in a factory of which the inventors are in the service, which method comprises the steps of:

a. effecting changes in the temperature of a material to be plastically worked;

b. determining variations in the metallographical condition of the material caused by the changes in the temperature of the material;

c. detecting a sudden change in the metallographical condition of the material caused immediately before the material becomes superplastic; and d. starting a plastic working of the material after having detected the sudden change in the material.

On the other hand, it has been well known in the art that, when a metal material undergoes metallographical changes during processing, the phenomenon called "superplasticity" may present itself to provide the possibility of an extremely large plastic working of the material. However, the temperature of metal material causing it to start changing in its metallographical condition depends not only upon its constituent elements to a slight degree, but also upon its history of heat treatment or other kind of processing and its rate of heating or cooling until the foregoing temperature may be reached. Also, when metal materials are heated or cooled for a relatively shorter period of time in an industrial scale, the conventional method of measuring the material temperatures during treatment is subject to such disadvantages as delays or errors in measurement; that is, with the conventional method, it is not easy to maintain the uniform conditions of measurement of the material temperature. For example, when the temperature of metal materials is measured by using a radiation pyrometer, the rate of radiation to the pyrometer may be varied according to the particular surface condition of the material. Also, when such a measurement is made by using a thermocouple-type thermometer, the measurement may be effected by the particular way of connection of the thermometer to the material.

Moreover, the temperature range of metal material producing the condition of superplasticity is relatively smaller; therefore, when the material has reached such a temperature, it is not easy to start a plastic working thereof, without losing time, so as to obtain a desired product. This difficulty has prevented the nature of superplasticity of metal material from being fully utilized in the plastic working thereof in an industrial mass production.

The difficulty of plastic working of metal utilizing its superplasticity may be described in more detail. Firstly, the temperature of metal material causing it to become superplastic varies according to the particular kind of the material, or the particular chemical composition thereof. In addition, even metal materials with the same chemical compositions may differ from one another in the foregoing temperature if they have different histories of processing. Thus, with a factory where a great number of metal materials are to be plastic worked, it is practically impossible in actuality to determine the "superplasticity temperature" of every individual material which may be different from the others in its chemical composition and/or processing history.

Secondly, if the "superplasticity temperatures" of metal materials are experimentally determined in advance by using test pieces, the temperature value so determined may not be reliable enough to ensure that the actual plastic working of the material can be made exactly when it has certainly reached its real "superplasticity temperature". The reason for this is not only that the determinations are subject to the inherent restriction that the temperature range of a metal material causing it to become superplastic is narrow (as described before), but that the (conventional) determinations themselves are not free from delays or errors (as described before). Hence, in no small case, such an experimentally determined value is not the real "superplasticity temperature" of the material. It may still be extremely difficult, therefore, to make a plastic working of the material, even with a prior attempt at detecting the foregoing temperature, exactly when the material has reached it.

From the foregoing reasons, in general it has been difficult to utilize the superplasticity of metal material for the plastic working thereof in an industrial scale and no company has yet introduced this technique for the above mentioned purpose, except the factory of which the inventors herein, who have developed the improved plastic working method as described before, are in the service. In addition, it seems that no company except the inventors' factory has yet had even the idea of utilizing superplasticity of metal for the plastic working thereof.

SUMMARY OF THE INVENTION

The primary object of the invention is to provide a method of plastic working of metal materials whereby a metal material, when having reached the temperature producing its superplastic condition, is plastically worked in such a timely manner as to enable the material to be shaped into a desired product. When this object is achieved, the plastic working efficiency is greatly increased.

Another object of the invention is to provide a method of plastic working of metal materials of the character stated whereby the plastic working of the material is made with a great degree of ease and a high accuracy of shaping without being affected by any internal factors such as the chemical composition or history of processing, such as heat treatment or the like, of the material nor by any external factors such as those related to the measurement of temperature of the material.

The foregoing two objects of the invention may be described in other words as follows: The first object of the invention is to provide a method for plastic working of metal material which includes a step of heating the material to a certain temperature so that the material may be easily worked. The plastic working of metal in its heated condition can be made more easily than in its cold condition (cold working). The second object of the invention is to provide a method for plastic working of metal material which includes the step of making the material superplastic in advance, followed by a plastic working thereof while the material is in a superplastic condition. This technique of plastic working provides the following advantages:

(1) Higher plasticity of the material results in increased plastic working efficiency.

(2) a great number of materials may be worked into desired shaped products, with a less possibility of defective ones coming out and therefore with a higher yield.

Still another object of the invention is to provide a method for plastic working of metal materials of the character stated which includes the step of determining, with ease and with a higher accuracy, when the material becomes superplastic, so that the plastic working thereof may be performed exactly when the material is in a superplastic condition.

According to the invention, the superplastic condition of the material is not detected by a direct method (such as measurement of the material temperature), but what is detected is a sudden change in the metallographical condition of the material as caused immediately before the material becomes superplastic. Upon the detection of the sudden change, the plastic working of the material is started. To be more precise, where a number of materials to be plastically worked differ from one another in their temperatures causing them to become superplastic because of their different qualities, or different chemical compositions, each individual material is plastically worked after detecting a sudden change in its metallographical condition which may be caused at a particular point of time different from those of all other different kinds of materials; similarly, where a number of materials to be plastically worked are of the same kinds, but still differ from one another in their temperatures in question since they have different histories of mechanical processing, heat treatment, etc., each individual material is plastically worked after detecting a sudden change in its metallographical condition as caused at a particular point of time depending upon its particular history described above. In short, in spite of the fact that the direct detection of the superplastic condition of metal material may be very difficult in actuality, the present invention enables the material to be plastically worked exactly when it is in such a condition since the method hereby includes the detection of the phenomenon preceding immediately before the material becomes superplastic, which may be called an "indirect but reliable technique of detecting the superplastic condition of the material".

Other objects and advantages of the invention will become apparent during the following discussion of the accompanying drawings.

BRIEF DESCRIPTION OF THE DRAWINGS

FIGS. 27-1 and 27-2 show a temperature pattern and electrical-resistance pattern of a metal material;

DESCRIPTION OF THE PREFERRED EMBODIMENTS

Figure 1:
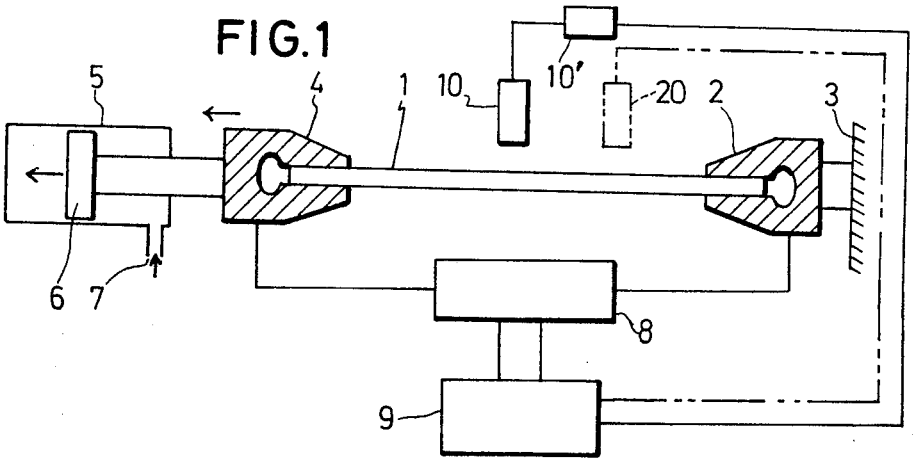
FIG. 1 shows an arrangement according to the invention for a plastic working of a metal material.

Referring to FIG. 1, a metal material 1 such as steel or the like is held at its both ends by a pair of chucks 2 and 4 connected to a fixed object 3 and a tension or stretching means 5, respectively. Both chucks 2 and 4 are designed to apply an electric current to the material 1. The stretching means 5 is provided with a piston 6 adapted to move, in a direction indicated by an arrow, by oil under pressure entering a chamber of the means 5 through a oil-supply port 7, so that the chuck 4 is moved in the same direction. The chucks 2 and 4 are also connected to an electric-power source or material-heating source 8 which is adapted to supply the chucks 2 and 4 with electric energy and connected to a circuit 9 for controlling the power supplied from the power source 8 to the material 1 through the chucks 2 and 4. Numeral 10 designates a means for observing metallographical changes effected in the workpiece 1, such as magnetic sensor for measuring the magnetic permeability of the workpiece 1. Numeral 10' designates a circuit for detecting the points of changes in magnetic property of the workpiece 1.

Figure 2:
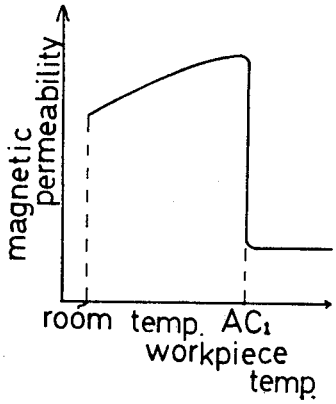
FIG. 2 shows the correlation of the temperature of a metal material and the magnetic permeability thereof.

The metal material 1 is plastically worked, e.g., stretch-formed by the arrangement of FIG. 1 as follows: First the power 8 is turned on to heat the material 1. As the material 1 is increased in temperature by the heating, the magnetic permeability of the material is also varied, and the permeability is measured from time to time or continuously by the magnetic sensor 10. And when such a sudden change in the permeability as indicated by $AC_1$ in FIG. 2 is detected, the control circuit 9 is operated to turn off the power 8 so as to stop heating the material 1, and the stretch means 5 is operated to stretch-form the material 1.

Figure 3:
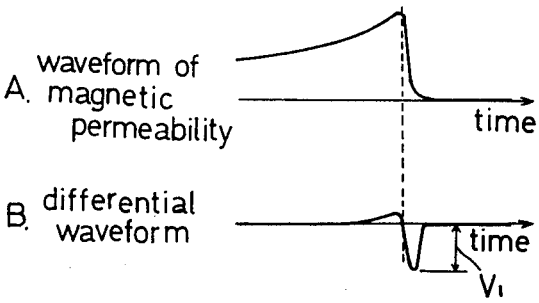
FIG. 3 shows a waveform of magnetic permeability of a metal material and a differential waveform thereof.

In the foregoing process the sudden change in the permeability of the material may be detected, for example, as follows: The permeability-detecting signals (FIG. 3 (A)) are differentiated in the detection circuit 10' so that differential waveforms as shown in FIG. 3 (B) are obtained, and when any differential waveform exceeds the predetermined level V1, the exceeding waveform indicates that the sudden change has been effected.

Also, in the foregoing process, the operation of the stretch means 5 may be started in such a timely manner as enables the plastic working of the material in the superplastic condition thereof, so that the working efficiency is greatly increased.

Furthermore, in the foregoing process, when the sudden change in the permeability has been detected, the power supply to the material may not be stopped immediately, but continued for some little time so that the material is stretch-formed at a temperature slightly increased from that at the time when the sudden change has been detected.

In passing, possible varieties as to the foregoing plastic working of metal material 1 may be given as follows:

(a) Besides or instead of a sudden change in the magnetic permeability of the material, that in any of the following properties thereof may be observed as presenting itself as a sudden change in the metallographical condition of the material:

(a-1) Electrical resistance (a-2) Increase or decrease in temperature caused by heat absorption or generation (a-3) In connection with ultrasonic waves (a-4) Elongation percentage (b) Any other plastic working well known in the art than the stretch forming may be effected to the material.

(c) A sudden change in the metallographical condition of the material may also be detected for the plastic working thereof when the material heated is cooled.

(d) Heating of the material may be made by any of the well-known methods such as by a furnace (by heated atmosphere, inductive heating, or the like), instead of applying an electric current to the material.

Figure 4:
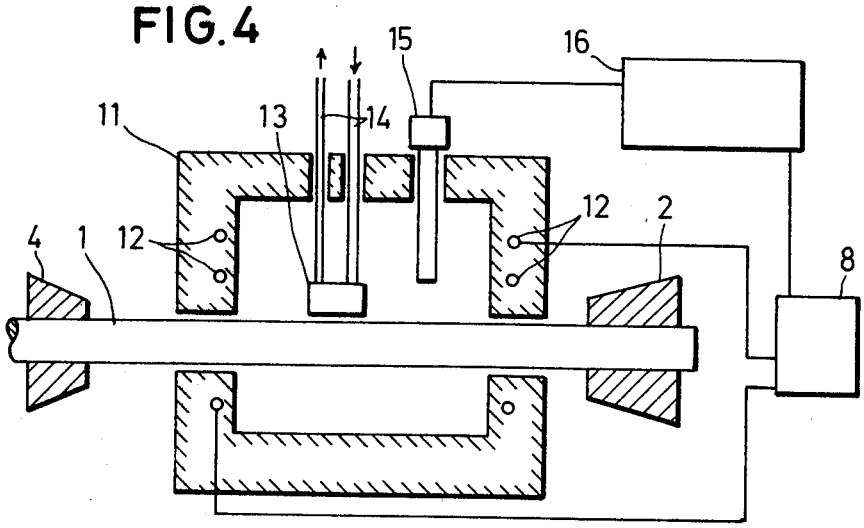
FIG. 4 shows another arrangement according to the invention for a plastic working of a metal material.

Referring to FIG. 4 illustrating another arrangement for heating of the material and another method of measurement, a metal material 1 is inserted through an electric furnace 11 and heated by heaters 12 provided in the furnace 11, and during heating, the damping factor or capacity of ultrasonic (supersonic) waves of the material 1 is measured by a supersonic flaw detector 13 protected against heat by water flowing through a pair of protection pipes 14 in directions indicated by arrows.

In the arrangement of FIG. 4, when the material 1 heated reaches a temperature indicated by D (FIG. 5), the inverse number S of material's capacity of damping of ultrasonic waves effects a sudden change. Then the heaters 12 are de-energized to stop heating the material 1, followed by a plastic working of the material. If desired, however, when the sudden change has been effected, the heating of the material may not be stopped immediately, but continued for such a short time as allows the material to be further heated by an additional amount of temperature set in a circuit 16 for controlling the processing temperature, with the increasing temperature of the material being measured by a temperature detector 15. And then the heaters 12 are de-energized to stop heating the material, followed by a plastic working thereof.

In the second heating and measuring arrangement of FIG. 4 and that which will follow hereafter, portions of sections exactly or substantially identical to those of the first arrangement in function are indicated by the same numerals as of those of the first one, so that no similar description is given of the similar arrangement.

Description will be next made of experiments made by the inventors. It is to be noted that, however, the following experiments or examples are given to further illustrate the invention, and it is to be understood that the invention is not limited in any way by the details described therein.

EXAMPLE 1

(In the arrangement of FIG. 1) A number of pieces of JIS SUP7 spring steel with a diameter of 12 mm. and a length of 1,000 mm were provided, and the materials were divided into a number of groups. Each material of each group was held at its both ends by the chucks 2 and 4, and rapidly heated by operating the power source 8 in such a manner, with a voltage applied across the chucks. During the heating, the magnetic permeability of the material was continuously measured by the magnetic sensor 10, and such a sudden change thereof as indicated by $AC_1$ in FIG. 2 was detected in a clear-cut manner.

In the foregoing treatment all the steels of all groups were subjected to the same heating conditions including the heating time.

Figure 6:
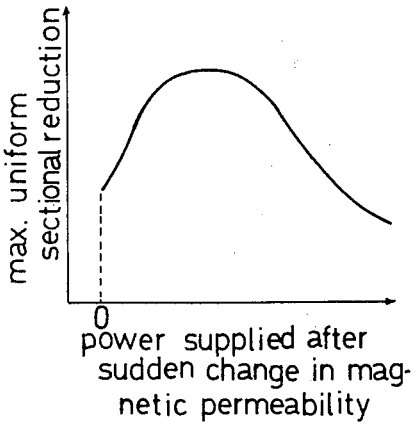
FIGS. 6 to 13 show variations in a variety of factors.

After the sudden change $AC_1$ in the permeability of the steels had been detected, the steels of each group were further supplied with electric current, without interruption of the supply between the detection of sudden change, in a different amount and for a different period of time from those of the steels of the other groups. Then the current supply was stopped, and the steels of each group were rapidly stretched at a rate of 250 mm/sec. by different distances of 50 to 1,000 mm. by pulling the chuck 4, holding one end of the steel, in the left-hand direction of FIG. 1. As a result, in each group, one or more of the steels thus stretched were uniformly reduced in diameter at its entire length, while the other steel or steels were not given such a result. Then, in a group or groups where only one steel obtained the foregoing satisfactory result, the reduction in the diameter of that steel was taken as the maximum reduction in the diameter of the steels obtained in that group. In a group or groups where two or more of the steels obtained the foregoing satisfactory result, the reduction in the diameter of the steel which was of the greatest reduction was taken as the maximum reduction in the diameter of the steels obtained in that group. Then, the maximum uniform reduction in diameter of each group was compared with those of the other groups. The results are shown in FIG. 6. It may be seen from FIG. 6 that a certain amount of energy (electric current in this Example) should be further supplied to the workpiece (as in this Example), after a sudden change has occurred in the magnetic permeability of the material, in order to uniformly reduce the diameter of the material as much as possible.

EXAMPLE 2

Figure 7:
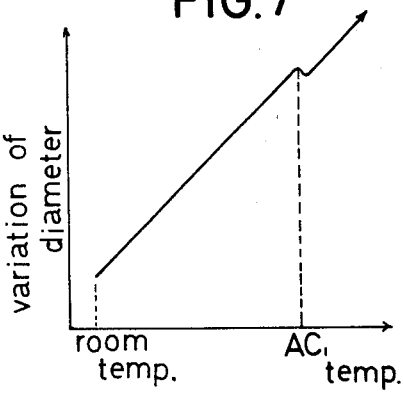

(In the arrangement of FIG. 1) A number of wire rods of S45C carbon steel with a diameter of 10 mm. were provided, and the material were divided into a number of groups. Each material of each group was rapidly heated in the same manner as in Example 1. During the heating, variations of the diameter of each material (caused by the heating) were continuously measured. The result is shown in FIG. 7 with a sudden change of diameter indicated by $AC_1$. In each group, the supply of electric current to the materials was continued, after the sudden change detected, for a different period of time and with a different amount of current from those in the other groups. Then the current supply was stopped, and the rods of each group were stretched in its axial direction in the same manner as in Example 1. In each group, as a result, one or more of the steels were uniformly reduced in diameter at its entire length, and the maximum reduction of diameter in each group was compared with those of the other groups. The results are shown in FIG. 8 where the maximum reductions of diameter are represented in correlation with the current-supply time after the sudden change in rod diameters has been detected.

Figure 8:
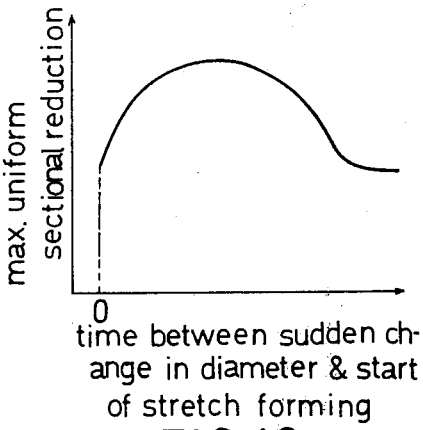

It may be seen from FIG. 8 that the maximum uniform reduction in the rod diameter is obtained by starting the plastic working or stretching of the rod a relatively shorter period of time (3.5 seconds in this Example) after the sudden change in diameter has been detected.

EXAMPLE 3

Figure 9:
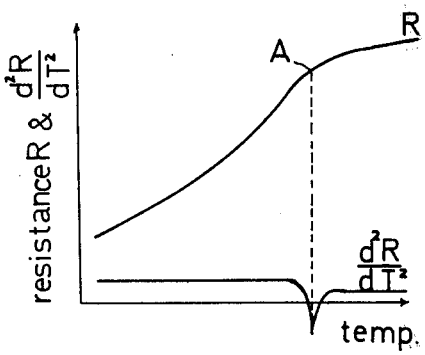

(In the arrangement of FIG. 1) A number of steel bars with a diameter of 4 mm. and a length of 700 mm. were provided and divided into a number of groups. All the bars of all groups were of a chemical composition of 0.15% C, 1.60% Si, and 0.83% Mn. Each bar of each group was rapidly heated in the same manner as in Example 1. During the heating, the amount of current through the bar (which was allowed to flow therethrough so as to heat the bar as in Example 1) was continuously measured and the surface temperature of the bar was simultaneously measured with a radiation pyrometer. Also variations in the electrical resistance R and $d^2R/dT^2$ of the bar caused by the changes in the temperature thereof were determined as shown in FIG. 9 where A indicates a point of the value of $d^2R/dT^2$ changing from positive to negative.

In each group, the current supply to each bar was continued, after the point A had been detected, for a different period of time and with a different amount of current from those in the other groups, and then the bar was stretched in the same manner as in the preceding Examples.

In each group, as a result, one or more of the steels were uniformly reduced in diameter at its entire length, and the maximum reduction of diameter in each group was compared with those of the other groups. The results are shown in FIG. 10.

Figure 10:
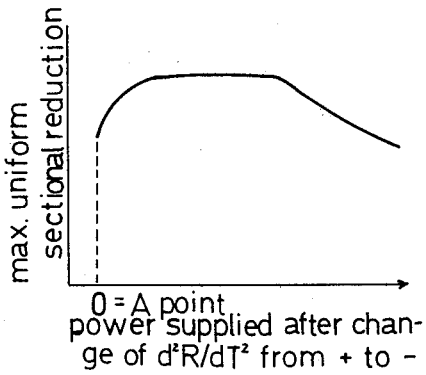

It may be seen from FIG. 10 that a certain amount of electric current should be further supplied to the bar after the change of the value of $d^2R/dT^2$ from positive to negative has been detected, in order to reduce the diameter of the bar as much as possible.

EXAMPLE 4

(In the arrangement of FIG. 4) A number of JIS SUP 9A spring steel bars with a diameter of 12 mm. and a length of 1,200 mm. were provided, and divided into a number of groups. Each bar of each group was heated evenly up to a temperature of 850° C. in the electric furnace 11. Then the bar was taken from the furnace 11 and, under the atmosphere, was held by metal chucks at its both ends of 100 mm. In this condition the bar was allowed to cool naturally, while the temperature of the central portion of the bar was continuously measured with a radiation pyrometer.

Figure 11:
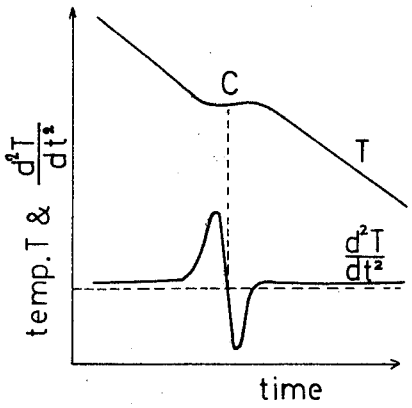
Figure 12:
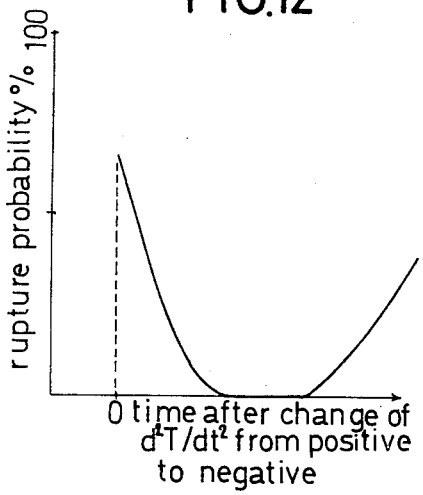

The foregoing measurements of temperatures are shown in FIG. 11 where C indicates a point of the value of $d^2T/dt^2$ (second-differential value of temperature relative to the time elapsed) changing from positive to negative. A certain period of time after the point C had been detected, the bar was stretched in the same manner as in the preceding Examples. As a result, it was found that the bar may be stretch-formed with no rupture by starting to stretch it with a certain period of time lapsed after the point C has been detected. FIG. 12 shows the probability of rupture of workpieces, with an indication that no probability of rupture of the workpieces exists in some points of time.

EXAMPLE 5

(In the arrangement of FIG. 4) A number of steel bars (to be used as materials of tools) with a diameter of 10 mm. and a length of 1,500 mm. were provided, and divided into a number of groups. All the bars of all groups were of a chemical composition of 0.39% C, 1.1% Si, 5.20% Cr, 1.20% Mo, and 0.35% V. Each bar of each group was held at its both ends by the chucks 2 and 4, and heated at its central section by the electric furnace 11, while the capacity or factor of the bar for damping the ultrasonic waves was measured by the supersonic flaw detector 13 (which was in a cooled condition).

Figure 5:
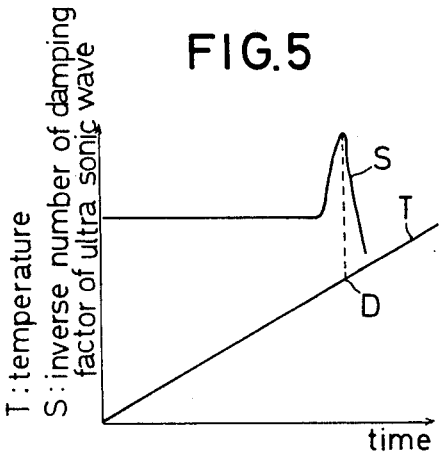
FIG. 5 shows variations of the factor of damping of ultrasonic waves and of temperature of a metal material.

The foregoing measurements of the damping factor of the bar are shown in FIG. 5 where D indicates a sudden change in the damping factor.

Then, an additional amount of temperature $\Delta T$ was set as a heat to be applied to the bar after the sudden change D has been detected, although the additional temperature $\Delta T$ for each group of materials was determined in a different amount or degree from those in the other groups. In each group, such an additional amount of heat was applied to each material, and the distance between the two chucks was increased by 400 mm. so that the material (bar) was stretched. In each group, as a result, one or more of the steels were uniformly reduced in diameter at its entire length (length of 800 mm. located in the furnace, however), and the maximum uniform reduction of diameter in each group was compared with those of the other groups.

Figure 13:
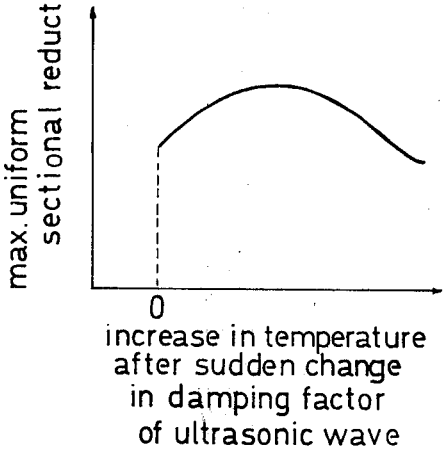

The measurements of maximum reductions in diameter are shown in FIG. 13 from which it is seen that the temperature of the bar should be maintained in a certain range, after a sudden change has been detected in the damping factor, in order to obtain the maximum uniform reduction in diameter.

Referring again to FIG. 1, another method of plastic working of metal materials may be carried out with the addition of a temperature detector 20, shown by a two-dotted line in FIG. 1, to the arrangement of FIG. 1. The detector 20 may be a radiation pyrometer or any other suitable means for measuring the temperature of the metal 1.

Figure 14:
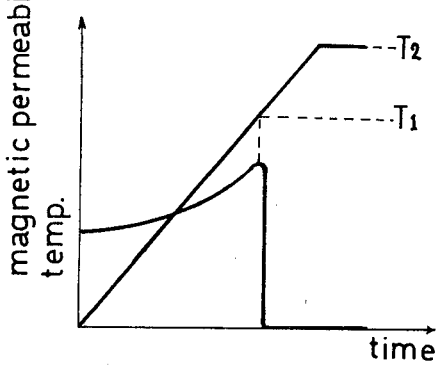
FIG. 14 shows the correlation of treatment time, temperature, and magnetic permeability of a metal material.

In the arrangement of FIG. 1 further including the temperature detector 20, when a sudden change in the magnetic property of the material 1 is detected by the sensor 10, the temperature $T_1$ of the material 1 determined by the detector 20 at that time is taken to be a reference temperature (FIG. 14). After the reference temperature is thus obtained, a slight amount of energy is further supplied to the material 1, e.g., by controlling the optimum-processing temperature control circuit 9 to cause the power source 8 to further supply the material with electric energy. The amount of the additional energy to be supplied depends upon the particular kind, dimensions, and processing conditions of the materials, and this additional amount is set in the control circuit 9 in advance. It is to be noted that the additional amount of energy to be supplied after the sudden change is also varied according to the method of supply (e.g., rapidly supply for a shorter period of time, slow supply for a longer period of time, or the like).

With such an additional amount of energy supplied, the workpiece 1 reaches the optimum temperature for plastic working thereof which produces the most easily plastic-workable condition in the material. Then the control circuit 9 is so operated as to stop the source 8 supplying the electric current to the material.

The material 1 thus having obtained the foregoing optimum temperature is then stretch-formed by operating the stretch means 5. The stretch forming of the material is performed most readily owning to the foregoing condition of the material.

The foregoing optimum temperature of different metal materials may be different from those of the other materials according to the particular kind and chemical composition of the material and/or particular variations effected in the material; however, according to the method herein, any particular kind of metal material heat-treated in particular conditions is allowed to reach the particular optimum plastic-working temperature of its own with exact accuracy, followed by the most-timely working thereof.

Figure 15:
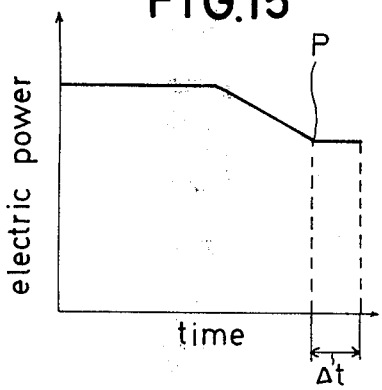
FIGS. 15, 16, and 17 show different supplies of energy to metal materials after sudden change detected in the metallographical condition of the materials, respectively.

For the purpose of increasing the temperature of the material up to the foregoing optimum degree after a sudden change in the metallographical condition thereof has been detected, any one of the following methods may be used:

(1) As mentioned above (and also as shown in FIG. 15), an additional amount of electric current predetermined according to the particular kind, dimensions, and processing conditions of the material is supplied to the material for a predetermined period of time $\Delta t$ after the reference temperature P has been detected.

Figure 16:
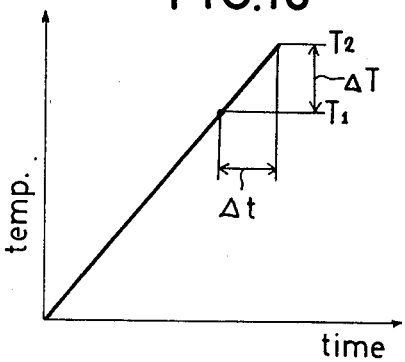

(2) As shown in FIG. 16, the material temperature is increased at a constant rate with the last period of time of such an increase indicated by $\Delta t$, followed by an increase indicated by $\Delta T$ so that $T_2$ is reached.

Figure 17:
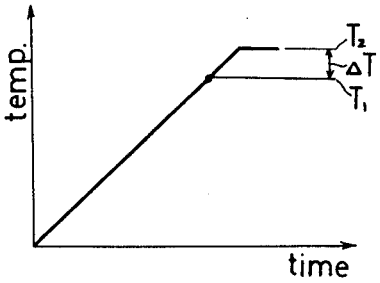

(3) As shown in FIG. 17, the temperature detector is adjusted with the reference temperature $T_1$ and the goal value is set therein, so that the material temperature is controlled by the values of temperature detection of the detector. (This method is a relative temperature control with the reference $T_1$, and the additional heating $\Delta T$ of the material is for a smaller range of 0° to 50° C. so that the control of additional heating may be made with a higher degree of accuracy.)

(4) When the material is to be cooled for and before a platic working thereof, an additional as well as normal treatment energy given to the material is of a negative one (cooling). The cooling control may be effected by using a similar method to the foregoing method (2) or (3) or any other suitable method.

(5) No additional amount of energy may be supplied to the material, but the material is kept at the constant temperature for a predetermined period of time.

Figure 18:
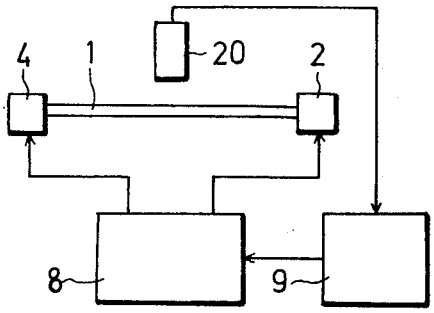
FIG. 18 shows a still another arrangement according to the invention for a plastic working of a metal material.
Figure 19:
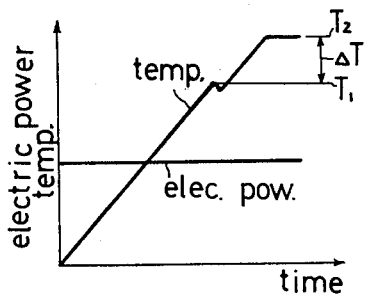
FIG. 19 shows the correlation of treatment time, electric power supplied, and temperature of a metal material obtained when the arrangement of FIG. 18 is employed.
Figure 20:
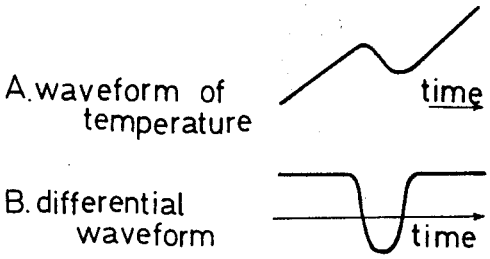
FIG. 20 shows a temperature waveform and differential waveform of a metal material obtained when the arrangement of FIG. 18 is employed.

Referring to FIGS. 18, 19, and 20, another arrangement (FIG. 18) provides a method of detecting a sudden change in the metallographical condition of metal materials by differentiating the measurements of the material temperature. That is, a metal material 1 is heated by receiving a constant supply of electric current from a power source 8 for a certain period of time (FIG. 19), while the material temperature varied by the heating as shown in FIG. 19 is measured. When such a sudden change as shown in FIG. 19 (which is also shown in an enlarged view of FIG. 20(A)) is effected in the temperature and determined by a detector 20, the signal having measured the sudden change is differentiated in a circuit 9 for controlling the optimum temperature of metal material for the plastic working thereof, so that such a signal as shown in FIG. 20(B) is obtained as detecting the sudden change in the material temperature. The temperature of the material determined by the detector at the time of sudden change is taken to be a reference temperature $T_1$, and the supply of electric current to the material is furhter continued until an additional amount of increase $\Delta T$ in temperature from the reference temperature is detected by the detector 20, so that the workpiece 1 is allowed to reach the optimum temperature $T_2$ for the plastic working thereof.

Figure 21:
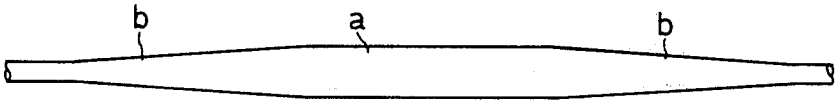
FIG. 21 shows a metal rod produced in a tapered shape according to the plastic working method of the invention.
Figure 22:
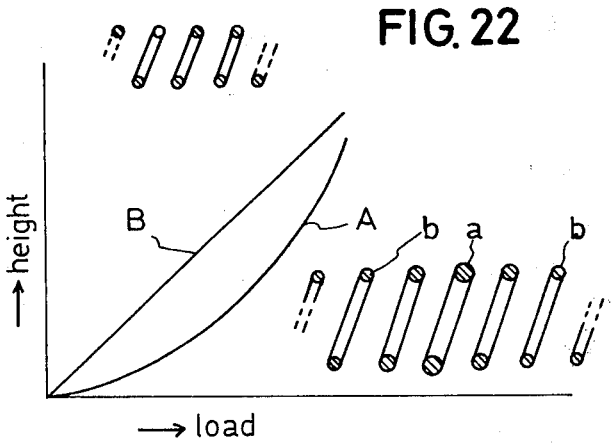
FIG. 22 shows characteristics of a coiled spring produced by using the taper rod of FIG. 21.

The foregoing method of plastic working may be employed, for example, for the production of such a taper rod as shown in FIG. 21. The taper rod of FIG. 21 has tapered portions b, b, on both sides of a central thicker section a, which are gradually decreased in diameter towards the rod ends. Such a taper rod may be coiled to produce a spring to be used in the production of cushions for automobiles or railway vehicles. As shown in FIG. 22(A), such a coil spring is characterized in that the height (or length) of the spring is not varied proportional to the load on the spring. Therefore, such as coil spring provides more comfort in the riding in vehicles than the conventional spring having a proportional correlation between the load thereon and the height thereof as indicated by FIG. 22(B).

Figure 23:
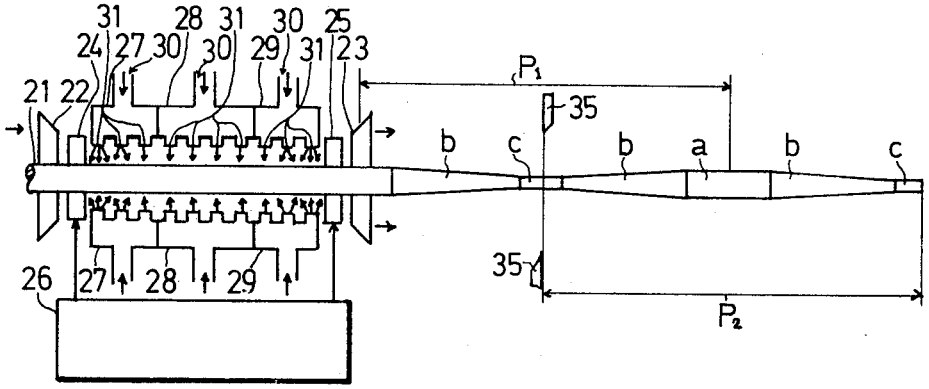
FIG. 23 shows a means which may be used for the production of taper rods according to the method herein.
Figure 24:
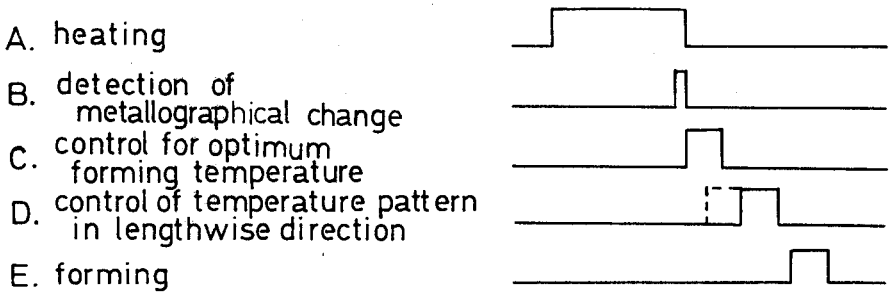
FIG. 24 shows a time chart.

The production of such a coil spring may be made according to a procedure of FIG. 24 by using such a system as shown in FIG. 23. In FIG. 23, a piece of rolled steel or other kind of metal 21 is supplied from a reel (not shown) in a direction indicated by an arrow, and is taken hold of by a fixed chuck 22, stretch chuck 23, and a pair of energizing chucks 24 and 25. The material 1 is then heated by operating the heating source 26 to supply electric current to the material through the chucks 24 and 25 (FIG. 24(A)). During the heating, the metallographical condition is observed, and when a sudden change in the condition is detected as shown in FIG. 24(B), the optimum temperature for the plastic working of the material is reached by supplying an additional amount of thermal energy to the material, as previously mentioned (FIG. 24(C)).

When the material has reached the foregoing optimum temperature, the additional supply of thermal energy (electric current in FIG. 23) to the material is stopped. Then the temperature of the material in the lengthwise or axial direction thereof is controlled (FIG. 24(D)) by using air-nozzle blocks 27, 28, and 29 which each have a plurality of nozzles 31 directed to the material to blow cooling gases (e.g., pressurized air) against the material. The cooling gas is supplied from a supply means (not shown) to a supply port 30. The blocks 27, 28, and 29 are each provided in number more than one, and each group of blocks is so located as to surround the material by all blocks. However, alternatively, the blocks 27, 28, and 29 each may be one block shaped in an annular manner so that the block surrounds the material in a continuous manner. The nozzles 31 of the blocks 27 and 29 closer to the energizing chucks 24 and 25, respectively, are adapted to blow more amount of cooling gases than those of them further from the chucks 24 and 25, respectively. With the cooling gases blown against the material from the air nozzles 31 (although no gases may be blown off from the nozzles 31 of the central blocks 28), the material is provided with a temperature pattern in the axial direction thereof (FIG. 24(D)), so that the material is given a plasticity gradient. As shown in FIG. 24(D), the production of temperature pattern may be started before the optimum-temperature control (FIG. 24(C)), is finished (as indicated by a dotted line of FIG. 24(D)).

After the material has been given a gradient of plastic workability in its axial direction, the plastic working thereof is started (FIG. 24(E)), by pulling the stretch chuck 23 in the right-hand direction of FIG. 23 to stretch-form the material in its axial direction, so that the material is allowed to elongated with different percentages of different portions thereof according to their different plastic workability (or different percentages of elongation of the different portions according to the gradient of deformation resistance). Then such a taper rod as shown in FIG. 23 is obtained which has tapered portions b each decreasing gradually in diameter in one direction. It is to be noted that such a plastic working of the material may be started before the production of temperature pattern of the material (FIG. 24(D)) is finished.

As may be seen from FIG. 23, the rod of the same Fig. may be provided, in a repeated manner, with a number of sections comprising a largest-diameter portion a, tapered portion b, and smallest-diameter portion c by repeating the foregoing operation. And the sections formed into the same shape are cut by a cutter 35 so that the required rods are obtained. In FIG. 23, $P_1$ designates a pitch of elongation of the material obtained by a single pulling or stretching operation, while $P_2$ designates a pitch of cutting the rod sections shaped.

According to the foregoing method, not only taper rods are produced with a higher efficiency, but also the metal material is cut with almost no amount of material loss as compared with the conventional method whereby a taper rod is made by cutting off the unnecessary portion of the rod material.

For the purpose of providing different portions of the material with different degrees of plastic workability, a temperature of a portion or portions of the material may be made lower than that of the portion having the greatest plastic workability, as previously mentioned. Also the same purpose may be achieved by making higher the temperature of such a portion than that of the most plastic workable portion. Furthermore, the temperature gradient of the material for the same purpose may be produced by heating the material in such a manner that the predetermined gradient is formed in the axial direction of the material, instead of cooling the material heated. Such a heat treatment of the material may be made by such methods as follows:

(1) In high frequency induction heating, the coil diameter or pitch of each point of the material in its axial direction is varied from those of the other points.

(2) In the heating of the material by gas, the supply rate of gas to each point of the material in its axial direction is varied from those of the other points.

(3) The power input to resistance-type heating elements is controlled.

Figure 25:
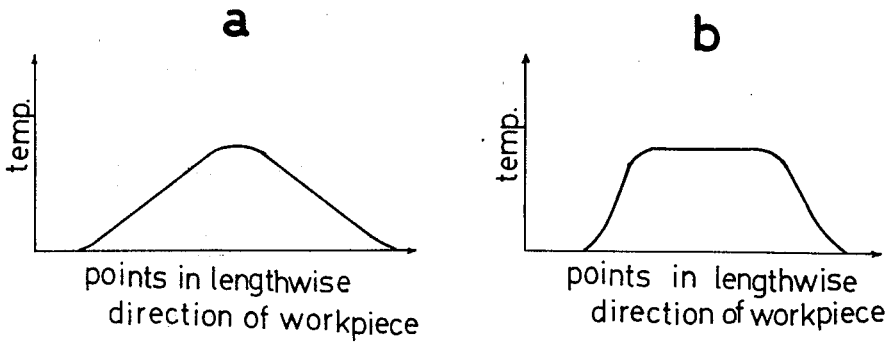
FIG. 25 shows examples of temperature patterns of metal materials.

The pattern of temperature gradient to be given to the material for providing different portions thereof with different plastic workability depends upon the particular kind of material, dimensions, heating temperature used and stretch conditions of the material and the particular tapered shape to be obtained; therefore, no comprehensive suggestion may be made of the pattern of temperature gradient, but it must be determined for each specific case. FIGS. 25(A) and (B) show examples of the pattern which may be used in some cases.

The metal material provided with the pattern of temperature gradient is subjected to a stretching or tensile force in such a manner that the material is given the distortion rate which has been usually predetermined according to the quality (alloy composition) and shape of the material and the dimensions before the stretch forming and those to be obtained by the stretch forming of the material. However, any other method of applying the tensile force to the material may be employed if required for the particular tapered shape to be obtained.

The speed of stretching the material for the required plastic forming thereof may not be maintained constant so that the predetermined distortion rate is obtained, but the stretching speed may be varied between the starting and finishing of the stretching so as to achieve the same purpose.

The foregoing method of tapering a metal material may be employed not only for a continuous material, but for a material of limited length in which to form one or two taper portions.

Also, according to the foregoing method of tapering metal materials, it is possible to produce not only such taper portions gradually decreasing in diameter (shown in FIG. 23), but also those having one or more steps or a wide variety of projections or recesses.

The taper rods made by the foregoing method may be employed for the production of taper-coil springs with great advantages, as previously mentioned. Also these rods may be used as materials of antennas. Moreover, if the rods are of a hollow metal material, they may be used as materials of ski sticks or street-light poles. And a wider variety of uses thereof may be possible.

Figure 26:
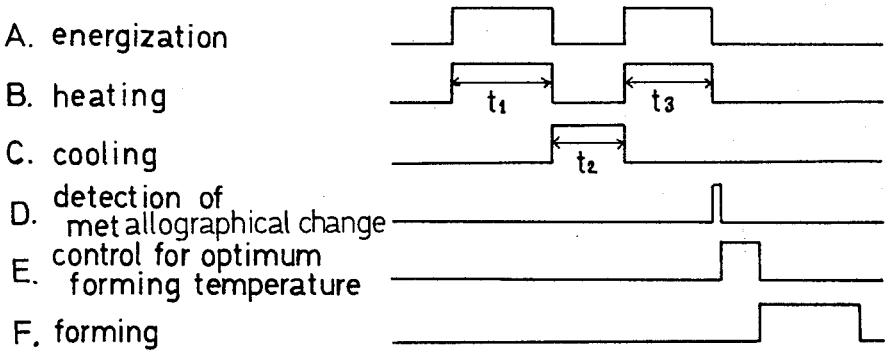
FIG. 26 shows a time chart illustrating another procedure of producing a taper rod according to the invention.
Figures 1, 27:
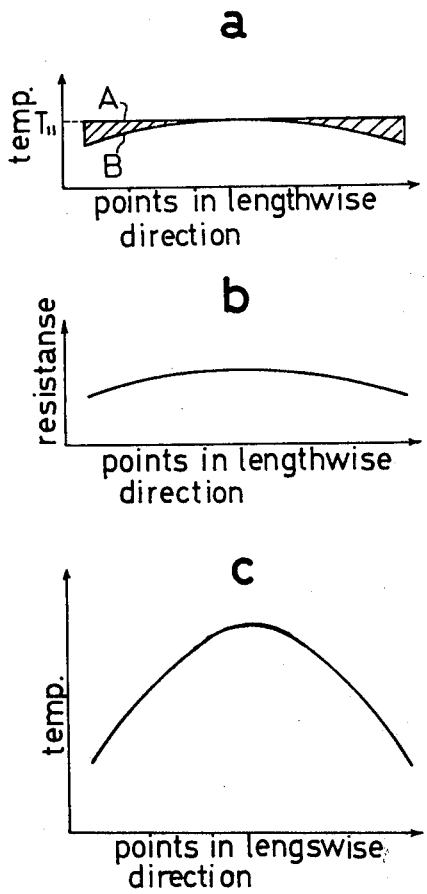
Figures 2, 27:
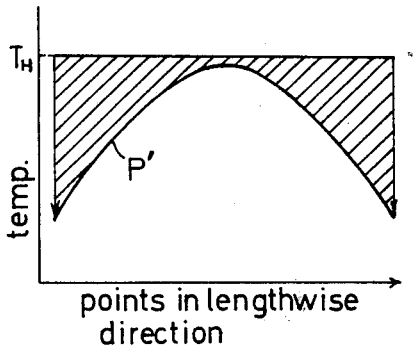

Referring to FIGS. 26 and 27-1, description will be next made of another procedure of producing taper rods by the system of FIG. 23. First a metal material 21 is heated by supplying electric current to the material from the power source 26 in the axial direction of the material (FIGS. 26(A) and (B)). The current supply to the material is made for a period of time indicated by $t_1$ of FIG. 26(B). By this heating, the temperature of the material is increased, at the entire length thereof, up to $T_{11}$ which is lower than the predetermined working temperature mentioned hereafter (FIG. 27-1(a)).

Then, the material is cooled for a period of time indicated by $t_2$ of FIG. 26(C) by blowing cooling gases against the material from the air nozzles 31 (although the central nozzles 31 may or may not blow cooling gases), so that the material is given a slight gradient of temperature in its axial direction as shown in FIG. 27-1(a)B. The temperature gradient or differences of temperatures of different portions of the material give a pattern of electrical resistance of the material as shown in FIG. 27-1(b).

Then the material is again heated, as indicated by $t_3$ of FIGS. 26(A) and (B), by supplying electric current to the material in which portions of higher temperature have higher electrical resistances, while those of lower temperature have lower electrical resistances. The current supply to the material is made in the same direction as those of temperature gradient or axial direction of the material, so that portions of different electrical resistance are related to each other in series. Therefore, the portions of higher electrical resistance is increased in temperature to a higher degree, generating a greater amount of heat, than those of lower electrical resistances, so that the temperature gradient of the material is varied to that of FIG. 27-1(c), after lapse of a certain period of time, which temperature gradient is of the optimum temperature of the material for the plastic working thereof.

The temperature pattern given to the material by the foregoing cooling treatment is to be set by experiment or calculation so that the different electrical resistance of different portions of the material determined by the pattern produce the suitable temperature pattern of FIG. 27-1(c) after current supplies to shown in FIG. 26 all have been made to the material.

When the predetermined amount of electric current has been supplied to the material for the predetermined period of time, it may be detected by the completion (of the current supply) itself whether the material has reached the optimum temperature for the plastic working thereof. Instead of such a method, however, the following method may be used for the same purpose: A sudden change in the metallographical condition of the material is detected (FIG. 26(D)), preferably in the portion of the material to be given the most plastic-workable condition, such as the central portion thereof. With the sudden change detected, the control for optimum temperature for plastic working is made in the same manner as before so that the material reaches the predetermined plastic-working temperature with the predetermined gradient (FIG. 26(E)).

After the material has reached the foregoing predetermined plastic-working temperature, the plastic working thereof is started in the same manner as before.

In the prior art of plastic-working, a metal material is evenly heated up to a predetermined higher temperature $T_H$ in its entirety, and a portion of the material thus heated is cooled so that the material is given a temperature gradient P′ (FIG. 27-2), and then the material given such a temperature gradient is plastic worked. In this prior process, the material must be made to radiate a large amount of heat as shown by oblique lines of FIG. 27-2 by employing a great amount of cooling energy. Therefore, the conventional method involves an extremely-large loss of energy. However, according to the method herein, only a radiation of heat indicated by oblique lines of FIG. 27-1(a) is involved, with a reduced loss of energy for the radiation.

Figure 28:
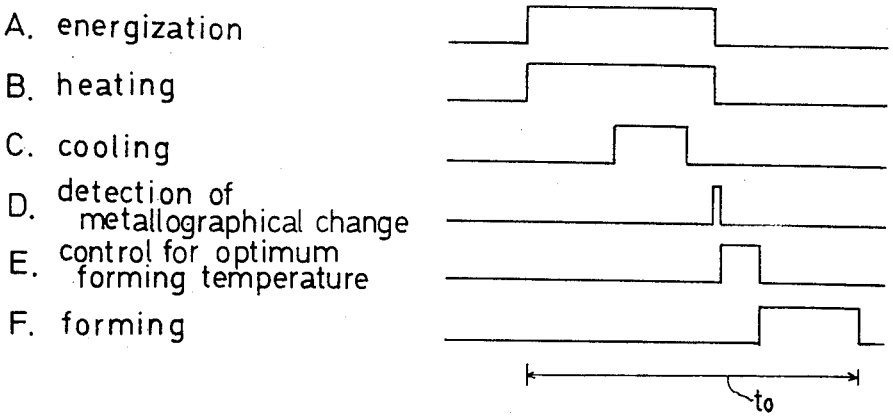
FIG. 28 shows a time chart illlustrating a still another procedure of producing a taper rod according to the invention.

FIG. 28 shows a procedure of producing a taper rod similar to that of FIG. 26, but different therefrom in some operational timings. According to this procedure, when the material is being still heated, the cooling thereof is started so that both treatments are made simultaneously from the middle of the heat treatment. This method is advantageous in that the required period $t_o$ of time for a series of operations is shortened.

Figure 29:
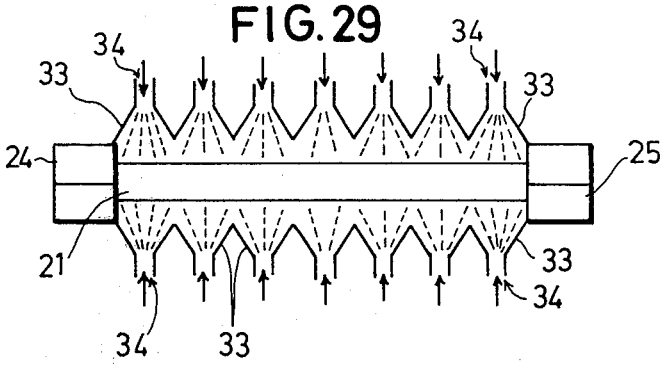
FIGS. 29 and 30 show examples of cooling means for the method herein.

Referring to FIG. 29, another embodiment of cooling means includes a plurality of air nozzles 33 for blowing cooling gases (e.g., pressurized air) against the material 21, which gases have been supplied from a supply-means (not shown) to supply ports 34. The nozzles 33 closer to the energizing chucks 24 or 25 are adapted to receive and blow off a more amount of cooling gas than those further from them.

Figure 30:
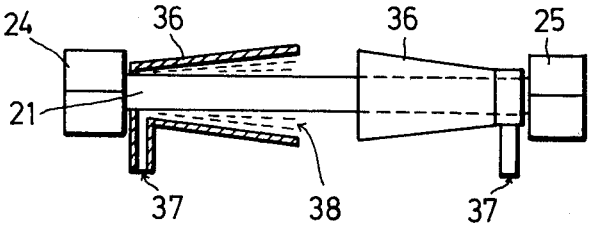

Referring to FIG. 30, a still another embodiment of workpiece-cooling means includes a pair of cylindrical walls 36 of tapered shape having an open end for the workpiece 21. The other or closed end of each wall 36 is provided with a supply port 37. In this arrangement, cooling gases are supplied into the wall 36 from the port 37, and then the gas is allowed to flow between the wall and the material (inserted therein) in such a manner that the gas stream moves at a rapid rate in the smaller-diameter section of the wall, while the stream moves at a slow rate in the larger-diameter section. Therefore the material is cooled to a higher degree in the smaller-diameter section and to a smaller degree in the other section of the wall. The gas stream is then allowed to come out of the open end of the wall.

Figure 31:
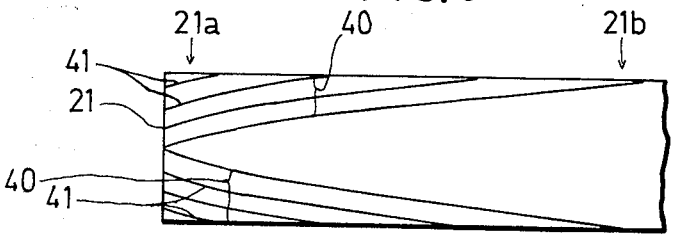
FIG. 31 shows a distribution of temperature of a metal material.

Description is next made of a still another procedure of producing the previously-mentioned taper rod. This procedure is different from the previously-mentioned second one only in the control of the temperature pattern of the material in its lengthwise direction. That is, in the procedure herein, cooling gases are blown from the nozzles 31 against the material 21 so that the outer or outer-most layer of the material is cooled to provide a layer 40, having a lower temperature than the central section of the material and resistant to elongation, on the circumference of the material (FIG. 31). As shown in FIG. 31, in the layer 40, a portion 21*a* to be left as having a larger diameter is of the largest thickness, while a portion 21*b* to be made into the most slender portion is of the smallest thickness (in some cases, having no thickness). The remaining section between the two extremes is given such a thickness as corresponds to the reduction in diameter predetermined as one to be obtained after the elongation forming. Generally, as indicated by isothermal lines 41 of FIG. 31, the distribution of temperature of the layer 40 is such that the surface of the portion 21*a* is of the lowest temperature, and the temperature is increased towards both rod axis and portion 21*b*. After the foregoing temperature control has been made, the material is elongated in its axial direction with the different portions thereof elongated in different amounts according to the thickness of the layer 40 in the particular different portion. As a result, a taper rod is obtained which is gradually decreased in diameter.

As many widely different embodiments of the invention may be made without departing from the spirit and scope thereof, it is to be understood that the invention is not limited to the specific embodiments thereof except as defined in the appended claims.

What is claimed is:

1. A method of plastic working of metal materials including the steps of:

(a) effecting changes in the temperature of a material to be plastically worked;

(b) determining variations in the metallographical condition of the material caused by the changes in the temperature of the material;

(c) detecting a sudden change in the metallographical condition of the material caused immediately before the material becomes superplastic; and (d) starting a plastic working of the material after having detected the sudden change in the material.

2. A method in accordance with claim 1 further including a step of supplying a predetermined amount of thermal energy to the material after the sudden change in the metallographical condition of the material has been detected and before the plastic working of the material is started.

3. A method in accordance with claim 1 or 2 wherein the variations in the metallographical condition of the material are measured by making measurements of the magnetic permeability of the material.

4. A method in accordance with claim 1 or 2 wherein the variations in the metallographical condition of the material are measured by making measurements of the property of the material related to ultrasonic waves.

5. A method for controlling the temperature of a metal material for plastic working thereof, including the steps of:

a. effecting changes in the temperature of a material to be plastic-worked;

b. measuring variations in the metallographical condition of the material caused by the changes in the temperature of the material;

c. detecting a sudden change in said metallographical condition of the material; and d. supplying an additional slight amount of energy to the material, after detecting said sudden change, so that the material reaches the optimum temperature for plastic working thereof.

6. A method for manufacturing taper rods including the steps of:

a. effecting changes in the temperature of a material to be shaped into a taper rod;

b. measuring variations in the metallographical condition of the material caused by the changes in the temperature of the material;

c. detecting a sudden change in said metallographical condition of the material;

d. supplying a predetermined additional amount of thermal energy to a section of the material to be reduced in diameter, after detecting said sudden change, so that said section of the material is brought into the most plastic-workable condition;

e. providing the material with a temperature gradient in the axial direction thereof so that the deformation resistance of the material is given a gradient in the axial direction of the material; and f. stretching the material in the axial direction so that said section of the material is made into a smallest-diameter portion and taper portions are formed with a diameter gradually decreased according to said deformation resistance of the material.

7. A method of plastic working of metal material includ- the steps of:

a. providing a material to be worked with a slight gradient of temperature;

b. supplying electric current to the material in the direction of said temperature gradient so that the material reaches a predetermined plastic-working temperature with a larger gradient than said slight temperature gradient; and c. subjecting the material thus heated to a plastic working by utilizing the difference of plasticity of the material due to the difference of said two temperatures.

8. A method in accordance with claim 7 wherein said step of providing the material with a slight gradient of temperature comprises:

a. supplying electric current to the material so that the material is heated up to a temperature lower than said predetermined plastic-working temperature; and b. cooling a portion of the material thus heated so that the material is given a slight gradient of temperature.

9. A method in accordance with claim 7 wherein said step of providing the material with a slight gradient of temperature comprises:

a. supplying electric current to the material so that the material is heated up to a temperature lower than said predetermined plastic-working temperature; and b. cooling a portion of the material during the heating of step (a) above so that the material is given a slight gradient of temperature in the direction of current supply of step (a) above.

* * * * *